US010256587B2

(12) United States Patent
Kauzlarich

(10) Patent No.: US 10,256,587 B2
(45) Date of Patent: Apr. 9, 2019

(54) SECUREMENT DEVICE FOR A CABLE CONNECTOR

(71) Applicant: William Kauzlarich, Carbondale, CO (US)

(72) Inventor: William Kauzlarich, Carbondale, CO (US)

( * ) Notice: Subject to any disclaimer, the term of this patent is extended or adjusted under 35 U.S.C. 154(b) by 0 days.

(21) Appl. No.: 15/977,953

(22) Filed: May 11, 2018

(65) Prior Publication Data

US 2018/0331480 A1 Nov. 15, 2018

Related U.S. Application Data

(60) Provisional application No. 62/504,797, filed on May 11, 2017.

(51) Int. Cl.

| | |
|---|---|
| ***H01R 24/64*** | (2011.01) |
| ***H01R 31/06*** | (2006.01) |
| ***H01R 13/639*** | (2006.01) |
| *H01R 33/97* | (2006.01) |
| *H01R 13/627* | (2006.01) |
| *H01R 13/629* | (2006.01) |
| *H01R 24/62* | (2011.01) |
| *H01R 13/635* | (2006.01) |

(52) U.S. Cl.

CPC ..... *H01R 31/06* (2013.01); *H01R 13/639* (2013.01); *H01R 24/64* (2013.01); *H01R 13/629* (2013.01); *H01R 13/6271* (2013.01); *H01R 13/6275* (2013.01); *H01R 13/62905* (2013.01); *H01R 13/62938* (2013.01); *H01R 13/62955* (2013.01); *H01R 13/635* (2013.01); *H01R 13/6397* (2013.01); *H01R 24/62* (2013.01); *H01R 33/97* (2013.01); *H01R 2201/04* (2013.01)

(58) Field of Classification Search

CPC ..... H01R 24/62; H01R 24/64; H01R 33/97; H01R 13/6397; H01R 13/629; H01R 13/62955; H01R 13/62938; H01R 13/62905; H01R 13/635; H01R 13/6271; H01R 13/6275

USPC ..... 439/676, 344, 133, 304, 345, 351

See application file for complete search history.

(56) References Cited

U.S. PATENT DOCUMENTS

| | | | | |
|---|---|---|---|---|
| 7,686,638 B2 * | 3/2010 | Boyd | H01R 13/6272 | 439/344 |
| 7,708,581 B2 * | 5/2010 | Weiss | H01R 13/6275 | 439/344 |

* cited by examiner

*Primary Examiner* — Abdullah A Riyami
*Assistant Examiner* — Justin M Kratt
(74) *Attorney, Agent, or Firm* — Donn K. Harms

(57) ABSTRACT

A securement device for engagement with a cable connector held in a mating socket by a release lever. The device features at least one socket formed into a body which is configured to engage with a cable connector which requires a release lever to maintain the cable connector in the socket. A locking pin engageable through opening on a sidewall is positionable to contact against a shoulder of the cable connector from which the release lever extends to hold the cable connector in the socket until the locking pin is removed. Defective cable connectors lacking an operative release lever can also be held in operative engagement in the socket by the locking pin.

13 Claims, 4 Drawing Sheets

SECUREMENT DEVICE FOR A CABLE CONNECTOR

This application claims priority to U.S. Provisional Patent Application Ser. No. 62/504,797 filed on May 11, 2017, which is incorporated herein in its entirety by this reference thereto.

BACKGROUND OF THE INVENTION

1. Field of the Invention

The present invention relates generally to network cables employed for telephones and computer systems. More particularly, the invention relates to a securement device for securing the plug engagement of RJ45 ethernet connector, or similarly configured connector, into a socket, to either maintain a tight connection for such connectors which are fully functional or to maintain a functional connection of such connectors where they are damaged by a broken release lever.

2. Prior Art

Telephone, data, and ethernet cables conventionally terminate, where not hardwired, with a connector which is adapted for engagement within a mating socket in an operative connection of the plurality of wires in the cable with mating connectors in the socket. A commonly employed connector and socket connection for ethernet cables having a plurality of twisted pairs of wires is the RJ45 cable connector.

In use, at one or both ends of an ethernet or telephone or data cable carrying electronic network or other signals, such cable connectors are placed at one or both ends of the cable. These cable connectors have connector contacts communicating with individual wires running through the cable. The connector contacts are generally formed in a line adapted for a contact against a spring loaded mating connection in a registered engagement within the socket to which the cable connector sits. In order to insure electronic signals passing from the connector contacts in the connector to the mating connection in the socket, conventionally, the connector contacts in the cable connectors are placed in a biased contact against a respective mating connector within the socket.

This biased connection is conventionally achieved by sliding the cable connector into the socket of choice, and pushing it into the socket until a flexible release lever bends to engage a mating connection in the socket. This mated connection of the release lever with the socket thereby holds the cable connector and connector contacts thereon in a biased engagement of the connector contacts against the spring loaded mating connection in the socket.

It is most important that this biased engagement of the connector contacts in the cable connector against the mating connectors in the socket is maintained. First, maintaining the two conductive surfaces in biased connection significantly enhances the communication of electronic signals therebetween. Second, a biased contact helps prevent corrosion at the point of electric connection between the two components.

Ethernet and other cables employed for computer networks and telephones and communications can be run for significant distances between two communications points. Frequently, the cables are patched together by engaging the terminating cable connector of one cable with an incoming cable connector on the next cable being engaged. Such connections can occur in remote underground positions, in attics and crawl spaces, and in other areas which can become hard to access or inaccessible at a subsequent time.

Consequently, it is important that the biased engagement between cable connectors and sockets be maintained at all costs, because a repair can cost thousands of dollars in worker time and can cause significant communications disruption until repaired. Unfortunately, because the engagement between cable connector and socket is in a biased connection, a simple depression of the flexible release lever on the cable connector can cause ejection of the cable connector from the socket or a disconnection of the connector contacts on the cable connector with the mating connectors in the socket. Such a depression of the release lever can be easily accidentally caused by moving ceiling tiles, positioning cables or weights on top of existing connections, or even by small animals touching the release lever.

A further problem in the current art occurs should the flexible plastic release lever engaged to a cable connector breaks off. Because the release lever is required to engage and maintain a biased connection between the connector contacts on the cable connector and the mating connectors in a socket, once the release lever breaks, the cable connector is useless. The only current option is to cut off the cable connector and re-engage a new one in a time-consuming process. As can be discerned, if a release lever is broken on a remotely positioned connection in an attic, crawlspace or wall, it is almost impossible to fix in this fashion.

The system herein disclosed provides a cable connector securing system which is employable to insure that an engaged cable connector, cannot be accidentally or otherwise disengaged from a socket to which it engages. The system herein also provides an easy-to-use repair system for cable connectors having broken release levers which allow for their repair and a re-engagement of the cable connector with a mating socket in seconds, and without complicated tools and the like.

The forgoing examples of related art, as to computer and telephone cable connector engagement, and limitations related therewith, are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art with regard to maintaining the biased engagement of ethernet and other cable connectors with sockets in which they operatively engage to carry electronic signals between two points.

In one mode, the system provides for a removable engageable locking pin adapted for traverse engagement across the opening for a socket. The locking pin engages to run along a path through the opening of the socket, such that when the cable connector is inserted to a biased engagement against mating connectors in the socket, the locking pin is insertable to maintain the biased connection even if the release lever is depressed.

The locking pin is configured to engage through aligned apertures on two opposing sides of the opening of the socket in which the cable connector engages. The two apertures are positioned such that engagement of the locking pin therebetween, will position one side of the release lever adjacent to, or in contact with, a formed shoulder on the cable connector from which the release lever extends.

This positioning of the locking pin on cable connectors, having an operatively engaged locking pin, will prevent the depression of the release lever to a point where its connection with the socket is released. Further, even in instances where the release lever has broken and been severed from the connection at the shoulder, when the locking pin is inserted through the socket, it contacts the shoulder of the cable connector and thereby holds it in the biased engagement within the socket.

Still further, in another mode, the system herein can be employed to engage a provided replacement cable connector to one which has a detached release lever. In this mode of the device, a cable connector receptacle has a receiving socket for the broken cable connector on a first side. Once the broken cable connector is engaged in the receiving socket, insertion of the locking pin holds it in operative engagement. On a second side of the connector receptacle is a cable connector projecting therefrom, which has an operative release lever thereon. This enables the quick repair of many cables which might be thrown away due to the inability of the user to cut and connect a new cable connector.

With respect to the above description, before explaining at least one preferred embodiment of the herein disclosed cable connector engagement invention in detail, it is to be understood that the disclosed cable connector securement system herein is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed cable connector securement system and method. It is important, therefore, that the claims be regarded as including such equivalent construction and methodology insofar as they do not depart from the spirit and scope of the present invention.

The objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features of the invention. It is intended that the embodiments and figures disclosed herein are to be considered illustrative rather than limiting. In the drawings.

Figure 1:
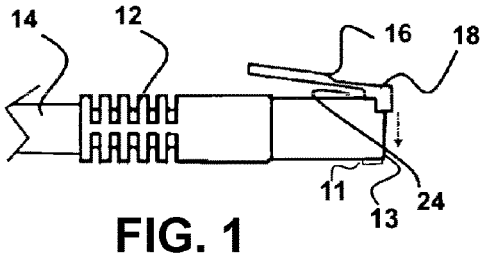
FIG. 1 shows a view of a conventional cable connector engaged to one or both ends of network and communication cabling such as an RJ45 connector, and showing an operative release lever extending from a shoulder portion of the cable connector.

Other aspects of the present invention will be more readily understood when considered in conjunction with the accompanying drawings and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the nose engagement device as it is oriented and appears in the drawings and are used for convenience only; they are not intended to be limiting or to imply that the device has to be used or positioned in any particular orientation.

Figure 2:
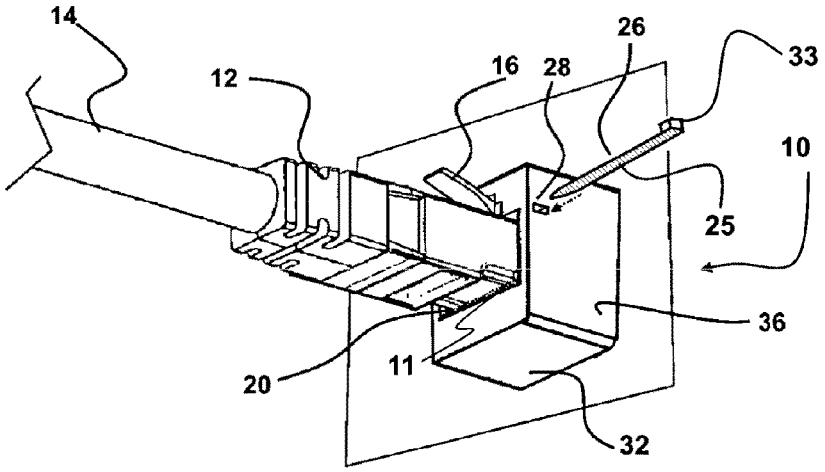
FIG. 2 shows a perspective view of a one socket configuration of the device herein where the cable connector, as in FIG. 1, being engaged to a receiving socket on a computer or on a wall or the like, and showing the locking pin ready for insertion along a locking pin pathway extending transverse across the socket opening in which the cable connector is positioned.
Figure 3:
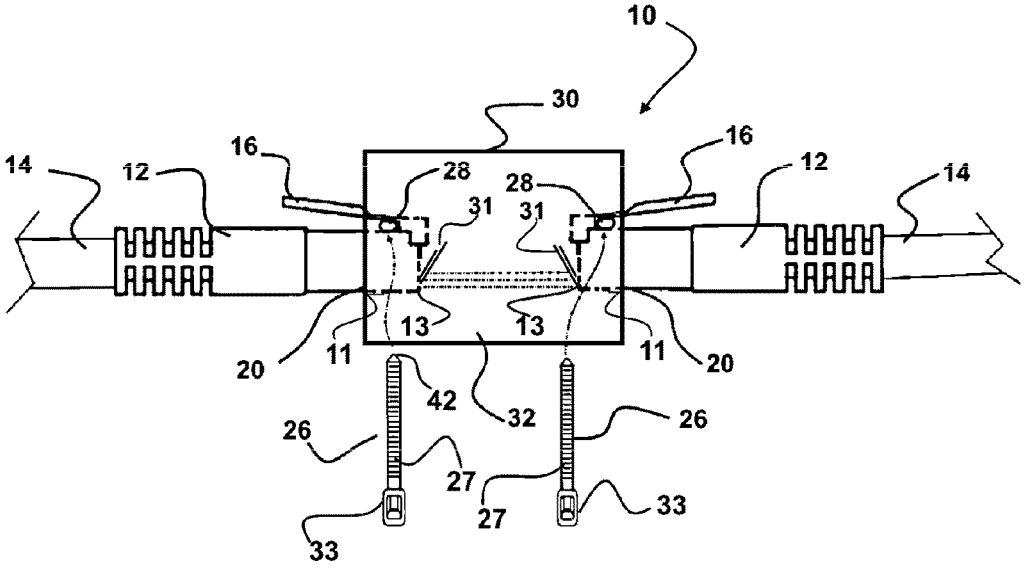
FIG. 3 shows a side cutaway view of a two socket configuration of the system herein, when employed to engage cable connectors from two cables in an operative electric connection and shows the two locking pins which, when engaged, will abut the shoulder from which the flexible release lever extends.

Now referring to drawings in FIGS. 1-13 wherein similar components are identified by like reference numerals, there can be seen in FIG. 1 a conventional RJ45 connector ethernet connector which is conventionally engaged to ethernet patch cords and the like to carry electronic signals to connector contacts 13 from wires in the cable 14 to pin connectors 31 in a socket 22 (FIG. 2 or 3). Other RJ type connectors 12 engage with similar network data and telephone cables 14 in a similar fashion. The device 10 herein is intended to be employed with any connector 12 which uses a flexible release lever 16 to bias a catch 11 on a lower edge of the connector 12, against an opening 20 edge or other mating edge in a socket 22, to maintain the connector 12 in the socket 22 with the connector contacts 13 in a biased contact with pin connectors 31 in a socket 22.

For example the device 10 herein, whether having one socket (FIG. 2) which is wall-positioned, or two sockets 22 at opposite ends of a body 32 of a cable junction 30 for two connectors 12, (FIGS. 3 and 7 for example), is employable with any connector 12 which where the release lever 16 is used to both lock and disengage the cable connector 12 from an operative electric engagement within the socket 22. By operable electric engagement is meant the device 10 maintains an operable electric connection between cable 14 wires terminating at connector contacts 13 on the connector 12 with pin connectors 31 located in one socket 22 such as at a wall or electronic device, or with two sockets 22 at opposite ends of a housing of a cable junction 30.

Shown in FIG. 2, is a view of the conventional cable connector 12 of FIG. 1, using a release lever 16, for which the device 10 herein is adapted to engage. In use, as noted, the connector 12 is conventionally engaged to one or both ends of network and communication cabling 14, such that the connector 12 operatively engaged with a socket 22. Also, depicted is an operative flexible release lever 16, extending from an engagement at a proximal end of the release lever 16 to a shoulder portion 18 of the cable connector 12. Such release levers 16 are positioned on the depicted RJ45 type connectors of FIGS. 1 and 2, 6, and 8 for example, and on other conventional connectors 12 noted which are employed for network, data, and phone communications.

In operative use, when the connector 12 is pushed into an engagement in a socket 22, the flexible lever 16 is bent by one side of the opening 20 of the socket 22 which biases a catch 11 on a lower surface of the connector 12 toward an edge or other mating connector in the socket 22. The lever 16, being urged by contact with one side of the opening 20, thus always causes a catch 11 to engage the opposite edge of the opening 20 or similar mount in the socket 22. This causes the connector 12 to lock into the socket 22 or similar receptacle with the connector contacts 13 in operative contact with the pin connectors 31 (FIG. 3).

In order to disengage the cable connector 12 from a socket 22, the biased contact of the lever 16 with one side edge of the opening 20 of a socket 22 causing the biased engagement of the catch 11, must be released by depressing the lever 16 with sufficient force to bend it toward the cable connector 12. In this action, the lever 16 is caused to deflect toward the top of the connector 12 and into a gap 24 adjacent a shoulder 18 (FIG. 1) underneath the release lever 16.

Once the lever 16 is depressed, the lock formed by the catch 11 from the biasing of the release lever 16 may be disengaged. This configuration of the lever 16, by default, is biased away from the connector 12 and works well to lock the catch 11 and thus the connector 12 into a socket 22.

Figure 4:
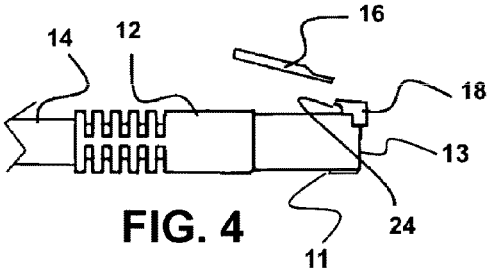
FIG. 4 shows the cable connector as in FIG. 1, but depicts a frequent disabling occurrence when the release lever breaks and detaches.
Figure 7:
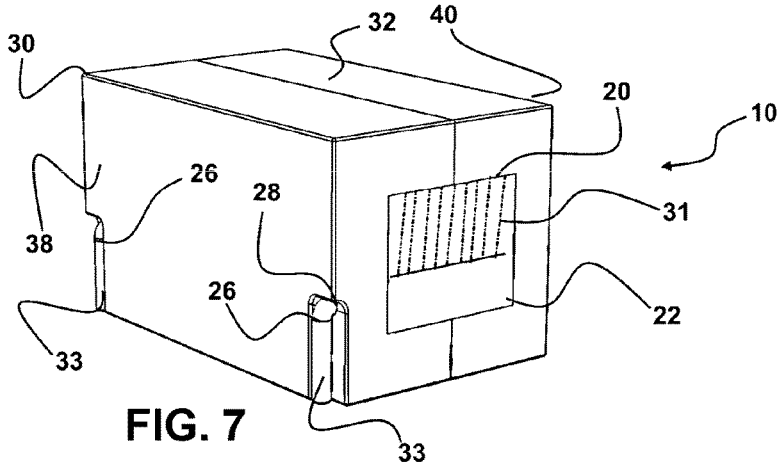
FIG. 7 shows the device as a cable junction similar to that of FIGS. 3 and 6, but with locking pins sized to engage into and between the two sidewalls of the cable junction and where the pins may be configured to impart bias to the connector and may be rotated to a locked engagement.

However, when the lever 16 breaks or becomes disengaged from the connector 12 such as shown in FIG. 4, the detached lever 16 renders the connector 12 and the attached cable 14 inoperative. This is because, if the release lever 16 does become disengaged from the connector 12, it is the only means to lock the connector 12 into a socket 22 in a biased contact of connector 12 contacts 13 with pin connectors 31 in the socket 22 (FIG. 7).

Without the lever 16 to hold the connector 12 in the socket 22 there is now way to maintain an operative engagement and electrical connection between the connector contacts 13 and the pin connectors 31 in a socket 22. Thus the cable 14 becomes inoperable and must be replaced, or the connector 12 must be replaced. Either task is costly either in parts and/or labor.

Figure 8:
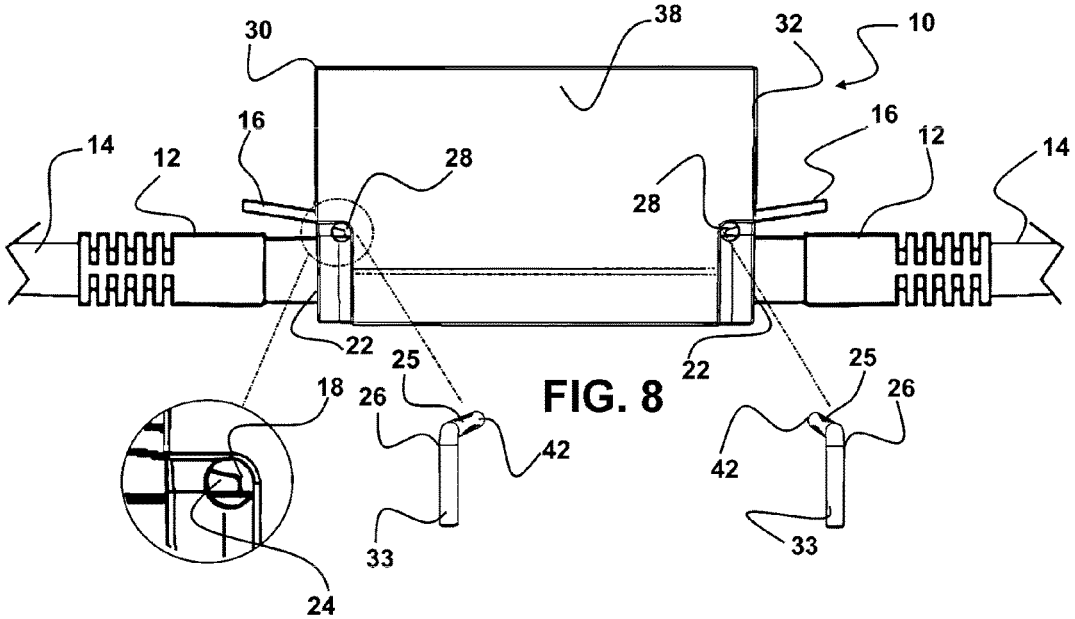
FIG. 8 shows a side view of the cable junction of FIG. 7, and shows the locking pins engageable through a first aperture in a first sidewall and a position fixing connection for the distal end of the locking pin, such as a second aperture in the opposing sidewall as shown in FIG. 9.

The system 10 herein, whether in a configuration as in FIG. 2 or FIG. 3 or 8, works with connectors 12 having operable levers 16 to form locked engagements of the connector 12 in a socket 22. The system 10 as in FIG. 2 or 3 or 8 and other figures, also works to hold connectors 12 with detached levers 16 (FIG. 6) operatively engaged in a socket 22 with the connector contacts 13 in biased contact with the pin connectors 31 in the socket 22 and thereby saves much time and money caused when connectors 12 break and lose their levers 16.

The system 10 provides a locking pin 26 adapted to engage across at a first opening 20 of a socket 22 in which the cable connector 12 is inserted. The locking pin 26 is inserted along a pin pathway running from at least a first aperture 28 formed in a first sidewall of the body of the socket 22 (FIGS. 2, 3, 5 and 8) preferably to the position fixing engagement for the distal end of the pin 26 at or in a second sidewall of the body of the socket 22. Such, for example, may be second aperture 29 (FIG. 9) formed in a second sidewall thereof. However, this position fixing engagement point for the distal end of the pin 26, might also be a ledge or recess at or adjacent the second sidewall such that the pin 26 is held substantially perpendicular to the opening 20.

The first aperture 28 and the fixed engagement point such as the second aperture 29 are aligned to form a locking pin pathway, such that the locking pin 26, when inserted therethrough, will have a central portion 25 of the locking pin 26 positioned in the gap 24 and abutting the shoulder 18 of the cable connector 12. So positioned in the locking pin pathway and through the gap 24, the contact of the central portion 25 of the locking pin 26 forms a lock against the shoulder 18, preventing the release lever 16 from being depressed to a point to release it from contact with the opening. Thus with the locking pin 26 communicating through the gap 24 in the connector 12, the removal of the biased engagement of the cable connector 12 into the opening 20 of the socket 22 is prevented until the locking pin 26 is removed.

The system 10 works especially well also where the locking pin 26 is detached or broken as shown in FIG. 4. This is because the positioning of the locking pin 26 will still hold the cable connector 12 in the biased engagement within the opening 20 with connector contacts 13 on the cable connector 12 biased against the pin connectors 31 in the opening 20 (FIG. 7). Such is provided by the central portion 25 of the locking pin 26, when placed in the locking pin pathway between the first aperture 28 and the engagement point at or adjacent the second sidewall such as the second aperture 29, maintaining a contact against the shoulder portion 18 of a broken connector 12. Thus the cable connector 12 even with a detached lever 16 is still useable.

Figure 5:
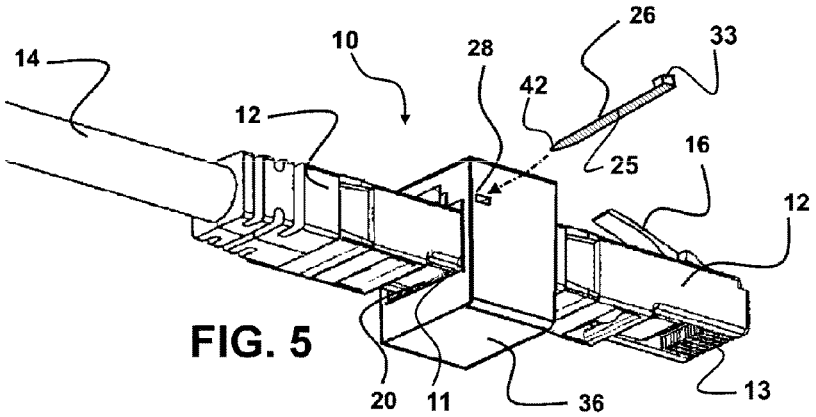
FIG. 5 shows a mode of device herein for employment to fix the cable connector of FIG. 4, and shows a cable receptacle having a socket in a body to engage the broken cable connector which is held by the locking pin. Further showing an operative cable connector extending from the opposite side of the body of the cable receptacle.
Figure 6:
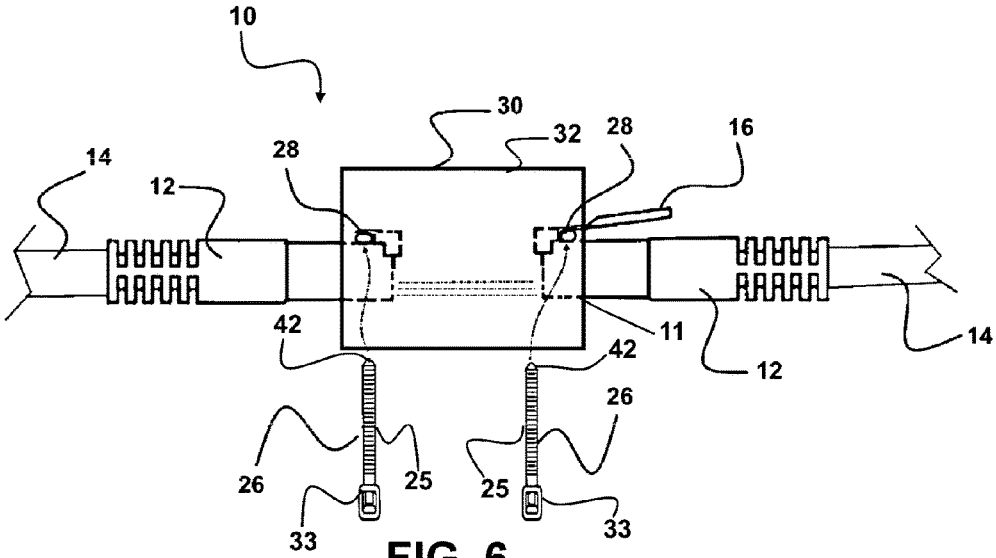
FIG. 6 is an example of employment of the device similar to that of FIGS. 3 and 8, to join a broken cable connector from a first cable to an operative cable connector from a second cable, in a secure tamper proof engagement.

Shown in FIG. 3, is another mode of the system 10 where it is configured with two sockets 22 instead of the mode shown in FIG. 2 for a single socket 22. Similar configurations of the device 10 operating the same as in FIG. 3, are shown in FIGS. 5, 6, and 8. In this two socket 22 mode, a cable junction 30 is provided having a housing or body 32 which has openings 20 for operative engagement of cable connectors 12 on both opposing ends. The cable connectors 12 engage within the two openings 20 and once so engaged, the locking pins 26 are inserted into the aperture or first hole 28 in one sidewall of the body 32 at each end, and the distal end of the locking pins 26 are engaged at the fixed engagement point adjacent or in the opposite sidewall, such that the locking pin 26 is held in an engaged position. In this engaged position the central portion 25 of the pin 26 extends through the gap 24 and contacts the shoulder portion 18 of the cable connector 12. Thereafter, unless the locking pins 26 are removed, the cable connectors 12 operatively engaged in both sockets 22 will remain in an operative biased connection within their respective openings 20.

In FIG. 4 a cable connector 12 as in FIG. 1, is shown, but with the very common defect where the plastic release lever 16, has broken from its connection to the shoulder portion 18 of the cable connector 12. This common occurrence causes thousands of cables 14 to simply be discarded due to the required tools, time, and skill required to cut the cable 14 and attach a new cable connector 12.

FIG. 5 shows how the system 10 herein may be employed to fix a defective connection of a broken cable connector 12 such as shown in FIG. 4. As shown in FIG. 6 and applicable to all modes of the system 10 herein in all figures, a cable receptacle 36 has an opening 20 on one end of the body 32 thereof adapted to engage the broken cable connector 12 therein. The broken cable connector is held in operative biased engagement in the opening 20 by the locking pin 26 once inserted.

Internal wiring connects to a fully functional cable connector 12 which extends from the opposite side of the body 32 from the opening 20. A release lever 16 is operative on the electrically engaged cable connector 12 thereby allowing normal use again. This mode of the system 10 can be employed to fix a single cable 14 and allow it to be re engaged in an existing socket 22.

Shown in FIG. 6 is an example of employment of the system 10, herein, to join a broken cable connector 12 from a first cable 14 in a connection to an operative cable connector 12 from a second cable 14 without need to cut and re-engage a new cable connector 12 to replace the broken one. This mode will also allow a broken cable 14 to be connected to a patch cable 14 which is engaged to an existing socket 22 and fix the problem of a broken connector 12 such as in FIG. 4. This junction holds both the broken and operative cable connectors 12 in an operative biased engagement within the openings 20 using the locking pins 26 engaged through the aperture 28 and extending across the opening 20. Further, as shown in FIG. 6 and FIG. 3, the locking pins 26 can include a lock to hold them in place. Such a lock may be as shown and described in FIG. 11 or as shown in FIG. 7, can be ribs 27 formed into the locking pin 26 which engage with a mating connector within the socket 22 like a conventional cable tie or zip-tie, rendering them unremovable. A button or release can be provided to allow removal of the locking pins 26 if ribbed 27.

FIG. 7 shows the device 10 operative in the same manner as that of FIG. 2-3 or 6, as a cable junction 30, but with locking pins 26 sized to engage along a locking pin pathway running between a first aperture 28 through the first sidewall 38 and a position fixing engagement point for the distal end 42 (FIG. 8, 12, 13, of the locking pin 26 adjacent or on the second sidewall 40 of the body 32 of the cable junction 30. Currently a second aperture 28 communicating through the second sidewall 40 provides the engagement point for the distal end 42, but a recess in the interior of the second sidewall 40 or a ledge adjacent it could also hold the distal end 42 aligned with a first end 33 of the locking pin 26. The locking pins 26 once engaged will impart bias to the connector 12 in a direction pushing the connector contacts 13 in a biased contact with the pin connectors 31.

FIG. 8 shows a side view of the cable junction 30 of FIG. 7, and shows the locking pins 26 engageable with a first aperture 28 communicating through the first sidewall 38 of the body 30 of the junction 30. While shown locking two connectors 12 having operational release levers 16, the cable junction 30 will also hold one or two damaged connectors 12, having detached release levers 16, and maintain the connector contacts 13 in operative biased contact with the pin connectors 31 within the socket 22 on each end.

Figure 9:
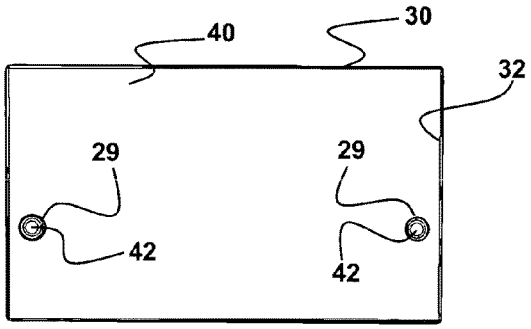
FIG. 9 shows a second sidewall of the cable junction of FIGS. 7-8 and shows the secondary apertures forming the position fixing engagement of the distal end of the locking pin which is sized to frictionally engage the distal ends inserted through secondary apertures.

Shown in FIG. 9, is the opposing or second sidewall 40 of the cable junction 30 shown in FIGS. 7-8. As shown, secondary apertures 29 provide the engagement point on the body 32 of the cable junction 30 for the distal ends 42 of the locking pin 26 to maintain the locking pin 26 aligned along the locking pin pathway running between the first aperture 28 through the gap 24 of the inserted connector 12 and to or adjacent the second sidewall 40. In this fashion, a side edge of the locking pin 26 contacts against the shoulder portion 18 of the connector 12 and holds it to maintain the connector contacts 13 biased against the pin connectors 31 within both sockets 22 formed into the body 32 of the cable junction 30.

Figure 10:
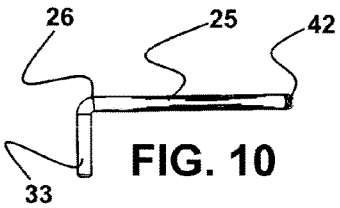
FIG. 10 depicts a side view of the locking pin shown in FIGS. 7-8 and similar in operation to those of FIG. 3, and shows a hemispheric distal end configured to more easily self-align and pass through the gap between the release lever and connector when inserted in the cable junction.

In FIG. 10 is depicted a side view of a locking pin 26 shown in FIGS. 7-8. As shown the distal end 42 is preferably formed in a taper, either in a point as in FIG. 6, or in a curved hemispheric shape shown in FIG. 10. Tapering the distal end 42 was found in experimentation to allow the locking pin 26 to more easily self-center and pass through the gap 24 between the release lever 16 and the surface of the connector 12 during insertion of the locking pin 26 into a cable junction 30. Also shown is the first end 33 of the locking pin 26 running in a direction traverse to the central portion 25 of the locking pin 26. Currently the first end 33 shown in FIGS. 7-13 is substantially perpendicular to the axis of the central portion 25. By substantially perpendicular is meant plus or minus 10 degrees from the axis of the first end 33 to the axis of the central portion 25.

Figure 11:
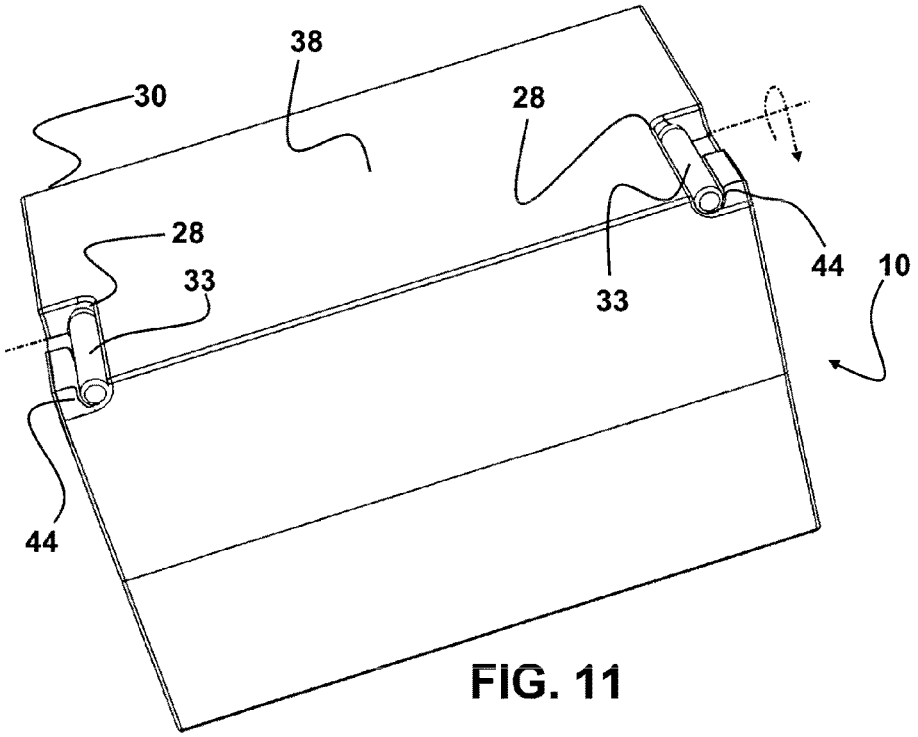
FIG. 11 depicts a bottom perspective view of the cable junction of FIGS. 7-9, and shows a recess configured to engage and fix the locking pins in position when rotated therein, and preventing removal unless the locking pins are first rotated out of engagement of the recess.

FIG. 11 depicts a bottom perspective view of the body 32 cable junction 30 of FIGS. 7-9, and shows a preferred recess 44 formed into the ends adjacent the first aperture 28. The substantially perpendicular first end 33 of the locking pin 26 allows the locking pin 26 to be rotated when engaged through the gap 24 of a connector 12 and to form the lock into the recess 44 for the locking pin 26, where it cannot be withdrawn from the first aperture 28 similar to the action of the ribs 27 as in FIG. 3. This lock is removably engageable by rotating the substantially perpendicular first end 33 of the lock pin 26 into an engagement within a recess 44 formed adjacent to the first aperture 28 through which the central portion 25 of the locking pin 26 passes. Release of the locking pin 26 would be accomplished by rotating the first end 33 of the locking pin 26 out of the recess 44 and then pulling it out of the first aperture 28.

Figure 12:
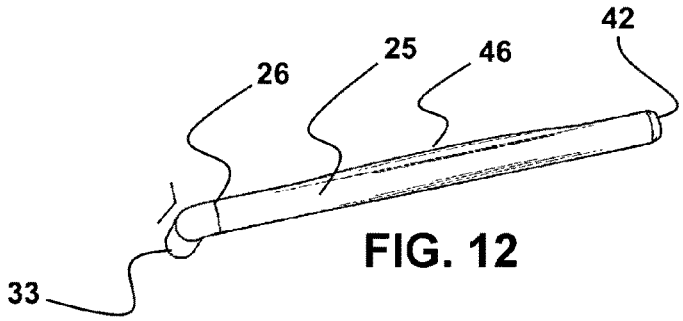
FIG. 12 shows the locking pin having a curved surface on one side substantially perpendicular to the axis of the short locking pin grip and imparts a biasing force to a connector inserted in the opening of a cable junction to bias connector contacts on the connector firmly against pin connectors in the socket.

FIG. 12 shows the locking pin 26 having a projecting surface 46 formed on one side of the central portion 25 in a position substantially perpendicular to the axis of the first end 33 of the locking pin 26. When the locking pin 26 is rotated such as shown in FIG. 11, the projecting surface 46 is rotated against the shoulder portion 18 of the connector 12 much like a cam, and thereby imparts a biasing force to the connector 12 inserted in the socket 22 of a cable junction 30 to force the connector contacts 13 on the connector 12 more firmly against the flexing pin connectors 31 within the socket 22. This pin with the projecting surface 46 works well where the pin connectors 31 within the socket 22 have grown weak and do not contact the connector contacts 13 well.

Figure 13:
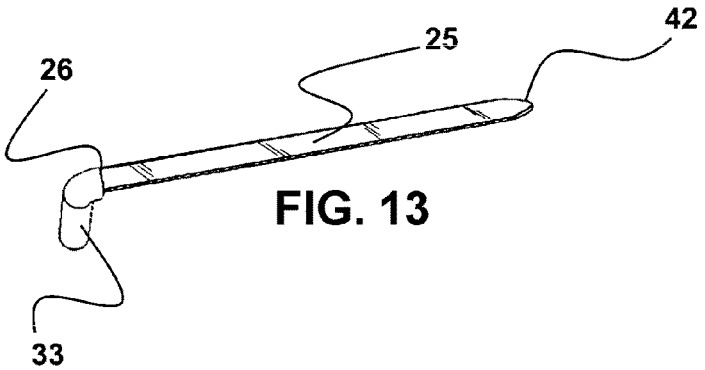
FIG. 13 shows a mode of the locking pin having a planar insertion portion and having a circular pin grip at one end which will when rotated fix in position within the recess 44 shown in FIG. 11.

FIG. 13 shows a mode of the locking pin 26 having a planar central portion 25 extending between the first end 33 and the distal end 42. In this mode the central portion 25 can be made slightly wider to contact the shoulder portion 18 of the connector 12 and urge it inward and the planar central portion 25 will slightly flex. The rounded first end 33 is configured for insertion within the recess 44 to lock the locking pin 26 in the cable junction 30, however it may be formed planar and the recess 44 formed planar to engage it. However the circular first end 33 and circular recess 44 has been found easier to engage.

While all of the fundamental characteristics and features of the cable connector securement system invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A securement apparatus for engagement with a cable connector held in a mating socket by a release lever, comprising:

a cable junction having a body;

said body having a first endwall positioned between a first sidewall and a second sidewall;

an opening in said first endwall communicating with a first socket positioned within said body, said first socket adapted for a removable engagement with a cable connector employing a release lever extending from a shoulder for holding said connector in said removable engagement;

a first aperture communicating through said first sidewall adjacent said first endwall;

a first locking pin having a central portion extending between a first end of said first locking pin and a distal end thereof;

said first locking pin insertable through said first aperture to an inserted position;

said central portion of said first locking pin while in said inserted position forming a contact against said shoulder of said first cable connector while in said removable engagement with said first socket, whereby said first locking pin in said inserted position prevents removal of said first cable connector from said first socket and maintains a said first cable connector lacking an operative said release lever in said removable engagement with said first socket.

2. The securement apparatus of claim 1, additionally comprising:

a position fixing engagement for said distal end of said first locking pin located in or adjacent said second sidewall.

3. The securement apparatus of claim 2 wherein said position fixing engagement of said distal end of said first locking pin is a second aperture formed in said second sidewall.

4. The securement apparatus of claim 1, additionally comprising:

said body having a second first endwall positioned between said first sidewall and said second sidewall, opposite said first endwall;

a second opening in said second endwall communicating with a second socket positioned within said body, said second socket adapted for a removable engagement with a second cable connector employing a release lever extending from a shoulder of said second connector for holding said second connector in said removable engagement with said second socket;

first pin connectors located in said first socket in operative electric engagement with second pin connectors in said second socket;

a third aperture communicating through said first sidewall adjacent said second endwall;

a second locking pin having a central portion extending between a first end of said second locking pin and a distal end of said second locking pin;

said second locking pin insertable through said third aperture to an inserted position of said second locking pin;

said central portion of said second locking pin while in said inserted position forming a contact against said shoulder of said second cable connector while in said removable engagement with said second socket in said second endwall, whereby said second locking pin in said inserted position prevents removal of said second cable connector from said second socket in said second endwall, and maintains a said second cable connector lacking an operative said release lever in said removable engagement with said second socket in said second endwall.

5. The securement apparatus of claim 4, additionally comprising:

a position fixing engagement for said distal end of said second locking pin located in or adjacent said second sidewall.

6. The securement apparatus of claim 5 wherein said position fixing engagement of said distal end of said second locking pin is a fourth aperture formed in said second sidewall.

7. The securement apparatus of claim 1, additionally comprising:

a lock for maintaining said first locking pin in said inserted position.

8. The securement apparatus of claim 7 wherein said lock comprises ribs formed along said central portion of said first locking pin, said ribs engageable with a mating connector within said body.

9. The securement apparatus of claim 7 wherein said lock comprises:

a recess formed into said body adjacent said first aperture:

said first end of said locking pin rotatable while in said inserted position to an engagement within said recess.

10. The securement apparatus of claim 4, additionally comprising:

a first lock for maintaining said first locking pin in said inserted position; and a second lock for maintaining said second locking pin in said inserted position.

11. The securement apparatus of claim 1, additionally comprising:

said distal end of said first locking pin being pointed.

12. The securement apparatus of claim 4, additionally comprising:

said distal end of said first locking pin being pointed; and said distal end of said second locking pin being pointed.

13. The securement apparatus of claim 12, additionally comprising:

a first lock for maintaining said first locking pin in said inserted position; and a second lock for maintaining said second locking pin in said inserted position.

* * * * *